US012303744B2

(12) United States Patent
Chiu et al.

(10) Patent No.: US 12,303,744 B2
(45) Date of Patent: May 20, 2025

(54) TREADMILL AND EXERCISE ACCIDENT DETECTION METHOD THEREOF

(71) Applicant: PEGATRON CORPORATION, Taipei (TW)

(72) Inventors: Chien-Kun Chiu, Taipei (TW); Jia-Ming Yang, Taipei (TW); Chih-Chang Chen, Taipei (TW); Ban-Chwen Hsi, Taipei (TW); Yang-Ching Chang, Taipei (TW); Cheng-Yu Kao, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 169 days.

(21) Appl. No.: 18/174,558

(22) Filed: Feb. 24, 2023

(65) Prior Publication Data

US 2023/0356035 A1 Nov. 9, 2023

(30) Foreign Application Priority Data

May 5, 2022 (TW) ..... 111117045

(51) Int. Cl.
*A63B 24/00* (2006.01)
*A63B 22/02* (2006.01)

(52) U.S. Cl.
CPC ..... *A63B 24/0087* (2013.01); *A63B 22/0235* (2013.01); *A63B 2220/18* (2013.01); *A63B 2220/40* (2013.01)

(58) Field of Classification Search
CPC ..... A63B 2220/13; A63B 2220/803; A63B 2220/833; A63B 2220/18; A63B 2220/16;
(Continued)

(56) References Cited

U.S. PATENT DOCUMENTS 11,951,351 B2 * 4/2024 Frank ..... A63B 22/025
2010/0093492 A1 * 4/2010 Watterson ..... A63B 22/0242 482/4

(Continued)

FOREIGN PATENT DOCUMENTS

TW 200621330 7/2006
TW 201819004 6/2018
TW M604646 12/2020

*Primary Examiner* — Megan Anderson
*Assistant Examiner* — Jonathan A Dicuia
(74) *Attorney, Agent, or Firm* — J.C. PATENTS

(57) ABSTRACT

A treadmill and an exercise accident detection method thereof are provided. The treadmill includes a treadmill body, an inertial sensor, and a processor. The inertial sensor is mounted on the treadmill body and continuously senses multiple sensed values while a treadmill belt of the treadmill is running. The processor is coupled to the inertial sensor, acquires multiple first sensed values sensed within a preset period by the inertial sensor, and analyzes the first sensed values sensed within the preset period to determine an event threshold value. The processor determines whether multiple second sensed values sensed not within the preset period by the inertial sensor satisfy a normal condition according to the event threshold value. If the second sensed values do not satisfy the normal condition, the processor controls the treadmill belt of the treadmill to stop running.

9 Claims, 5 Drawing Sheets

(58) Field of Classification Search
CPC . A63B 2220/40; A63B 22/0235; A63B 22/02; A63B 24/0087; A63B 71/0054; A63B 2071/0081
See application file for complete search history.

(56) References Cited

U.S. PATENT DOCUMENTS

| | | | | |
|---|---|---|---|---|
| 2013/0274066 | A1* | 10/2013 | Ashby | A63B 24/0062 482/4 |
| 2018/0099181 | A1* | 4/2018 | Powell | A63B 21/0084 |
| 2019/0336827 | A1* | 11/2019 | Intonato | A63B 71/0622 |
| 2022/0401813 | A1* | 12/2022 | Guccione | A63B 22/025 |

* cited by examiner

TREADMILL AND EXERCISE ACCIDENT DETECTION METHOD THEREOF

CROSS-REFERENCE TO RELATED APPLICATION

This application claims the priority benefit of Taiwan application serial no. 111117045, filed on May 5, 2022. The entirety of the above-mentioned patent application is hereby incorporated by reference herein and made a part of this specification.

BACKGROUND

Technical Field

The disclosure relates to an exercise equipment, and particularly relates to a treadmill and an exercise accident detection method thereof.

Description of Related Art

Modern people pay more and more attention to the importance of exercise, and the treadmill is a very common and popular exercise equipment. Users may walk or run on the treadmill belt of the treadmill to achieve the purpose of exercising. However, when the user falls on the treadmill or foreign objects (such as pets, children, water bottles or other exercise equipment) are drawn under the bottom of the treadmill by the treadmill belt, serious injuries may be caused to the user or the children or pets drawn under the bottom of the treadmill. Currently, the existing accident prevention method for treadmills is to set a safety key. One end of the safety key is inserted on the treadmill, and the other end of the safety key is tied to the user. Once the user on the treadmill falls, the safety key is pulled out, causing the treadmill to stop operating to avoid expansion of injuries. However, since the safety key is required to be tied to the user, this method is not favorable to the user.

SUMMARY

In view of this, the disclosure proposes a treadmill and an exercise accident detection method thereof, which can detect in real time whether an accident during the use of the treadmill occurs, so as to improve the safety of using the treadmill.

A treadmill of an embodiment of the disclosure is provided, which includes a treadmill body, an inertial sensor, and a processor. The inertial sensor is mounted on the treadmill body and continuously senses multiple sensed values while a treadmill belt of the treadmill is running. The processor is coupled to the inertial sensor, acquires multiple first sensed values sensed within a preset period by the inertial sensor, analyzes the first sensed values sensed within the preset period to determine an event threshold value, and determines whether multiple second sensed values sensed not within the preset period by the inertial sensor satisfy a normal condition according to the event threshold value. If the multiple second sensed values do not satisfy the normal condition, the processor controls the treadmill belt of the treadmill to stop running.

An exercise accident detection method of an embodiment of the disclosure is provided, which is suitable for a treadmill. The method includes the following steps. Multiple sensed values are continuously sensed while the treadmill belt of the treadmill is running by the inertial sensor mounted on the treadmill. Multiple first sensed values sensed are acquired within a preset period by the inertial sensor. The multiple first sensed values sensed in the preset period are analyzed to determine an event threshold value. Whether multiple second sensed values sensed not within the preset period by the inertial sensor satisfy a normal condition is determined according to the event threshold value. If the second sensed values do not satisfy the normal condition, the treadmill belt of the treadmill is controlled to stop running.

Based on the above, in the embodiment of the disclosure, the inertial sensor is mounted on the treadmill body to perform sensing. When a user is exercising on the treadmill, the multiple first sensed values sensed within the preset period may be analyzed first to determine the event threshold value. After the event threshold value is determined, whether the multiple second sensed values sensed by the inertial sensor satisfy the normal condition may be determined according to the event threshold value, so as to detect whether a treadmill exercise accident during the use of the treadmill occurs. If the multiple second sensed values do not satisfy the normal condition, it means that the treadmill exercise accident during the use of the treadmill has occurred, and consequently the treadmill belt of the treadmill is controlled to stop running to avoid continuous expansion of injuries. Based on this, the safety of using the treadmill can be improved.

In order to make the above-mentioned features and advantages of the disclosure more comprehensible, the following embodiments are described in detail together with the accompanying drawings.

DESCRIPTION OF THE EMBODIMENTS

Figure 1:
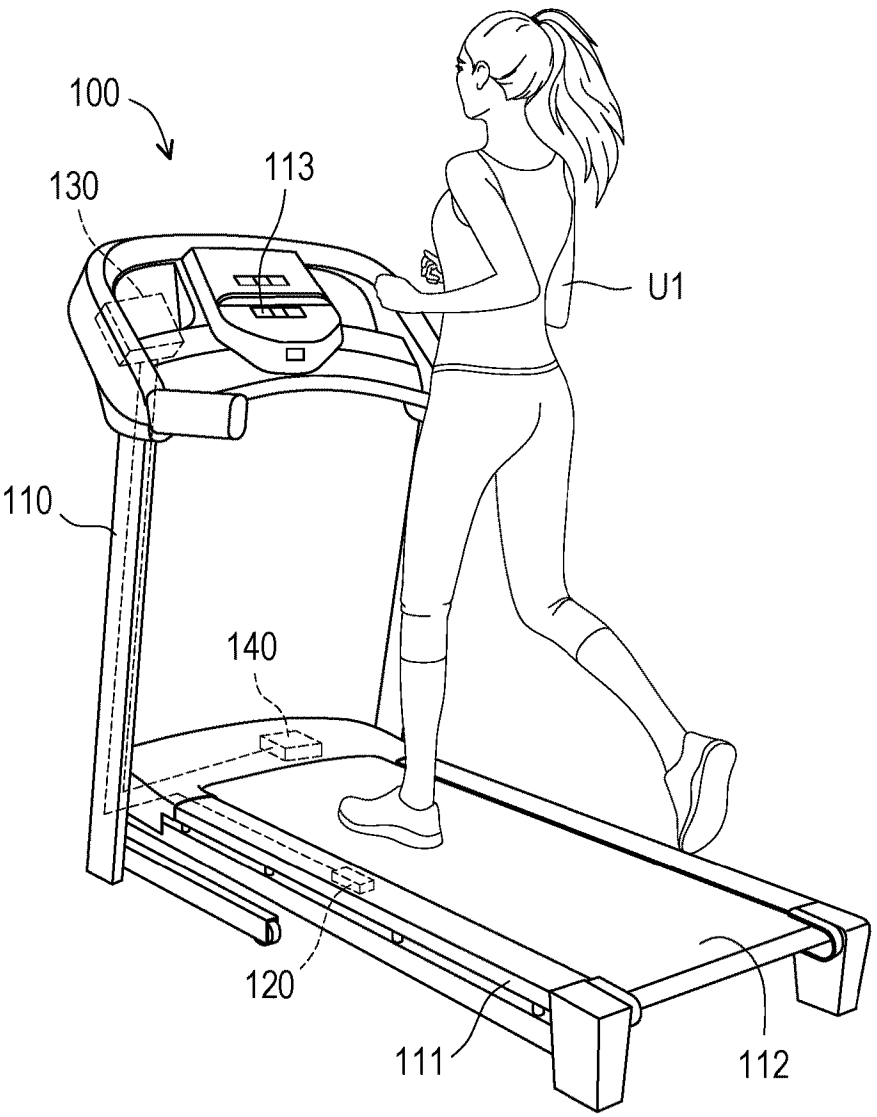
FIG. 1 is a schematic diagram illustrating a treadmill according to an embodiment of the disclosure.

Part of the embodiments of the disclosure will be described in detail with reference to the accompanying drawings. Regarding the referenced reference numerals in the following description, when the same reference numerals appear in different drawings, the reference numerals will be regarded as the same or similar components. These embodiments are only a part of the disclosure, and do not reveal all possible implementations of the disclosure. Rather, these embodiments are only examples of methods and devices within the scope of the disclosure.

FIG. 1 is a schematic diagram illustrating a treadmill according to an embodiment of the disclosure. Referring to FIG. 1, a treadmill 100 includes a treadmill body 110, an inertial sensor 120, a processor 130, and a power management device 140. The inertial sensor 120, the processor 130, and the power management device 140 are mounted on the treadmill body 110, and the processor 130 is coupled to the inertial sensor 120 and the power management device 140.

The treadmill body 110 may include a pedestal 111, a treadmill belt 112, and an input device 113. The pedestal 111 is disposed with a treadmill belt 112. When the treadmill 100 starts, the treadmill belt 112 on the pedestal 111 is driven by a motor to run. The treadmill belt 112 is for a user U1 to step on, and the feet of the user U1 repeatedly stride along with the running of the treadmill belt 112. The user U1 may input a set speed through the input device 113 to control a running speed of the treadmill belt 112. The input device 113 is, for example, a key or a button, which is not limited in the disclosure.

The inertial sensor 120 is mounted on the treadmill body 110 and is used to sense multiple sensed values, and the multiple sensed values may be used to present a motion state of the treadmill 100. In the embodiment of FIG. 1, the inertial sensor 120 is mounted on the pedestal 120, but the disclosure is not limited thereto. In addition, the embodiment in FIG. 1 is described by taking one inertial sensor 120 as an example, but the disclosure does not limit the number of inertial sensors. The inertial sensor 120 may include an acceleration sensor, a gyroscope or a combination thereof, and the sensed values output by the inertial sensor 120 include acceleration sensed values, angular velocity sensed values or a combination thereof. The acceleration sensor may be used to output the acceleration sensed value, and the gyroscope may be used to output the angular velocity sensed value.

The processor 130 may be used to control actions of various members of the treadmill 100, such as a central processing unit (CPU), or other programmable general-purpose or special-purpose microprocessor, digital signal processor (DSP), programmable controller, application specific integrated circuit (ASIC), programmable logic device (PLD) or other similar components or a combination of the above components.

The power management device 140 is used to provide power to the treadmill 100. In an embodiment, the power management device 140 may receive utility power through a plug, and convert the utility power into a power source suitable for the treadmill 100.

In the embodiment of the disclosure, multiple sensed values may be continuously sensed while the treadmill belt 112 of the treadmill 100 is running by the inertial sensor 120. Whether an accident during the use of the treadmill 100 occurs may be detected by the processor 130 according to the multiple sensed values provided by the inertial sensor 120. The accidents include the user U1 falling down, foreign objects hitting the treadmill 100, or foreign objects being drawn under the bottom of the treadmill 100 and so on. In this way, when an accident during the use of the treadmill 100 occurs, the processor 130 may control the treadmill belt 112 to stop running, so as to avoid continuous expansion of injuries caused by improper use of the treadmill 100.

Figure 2:
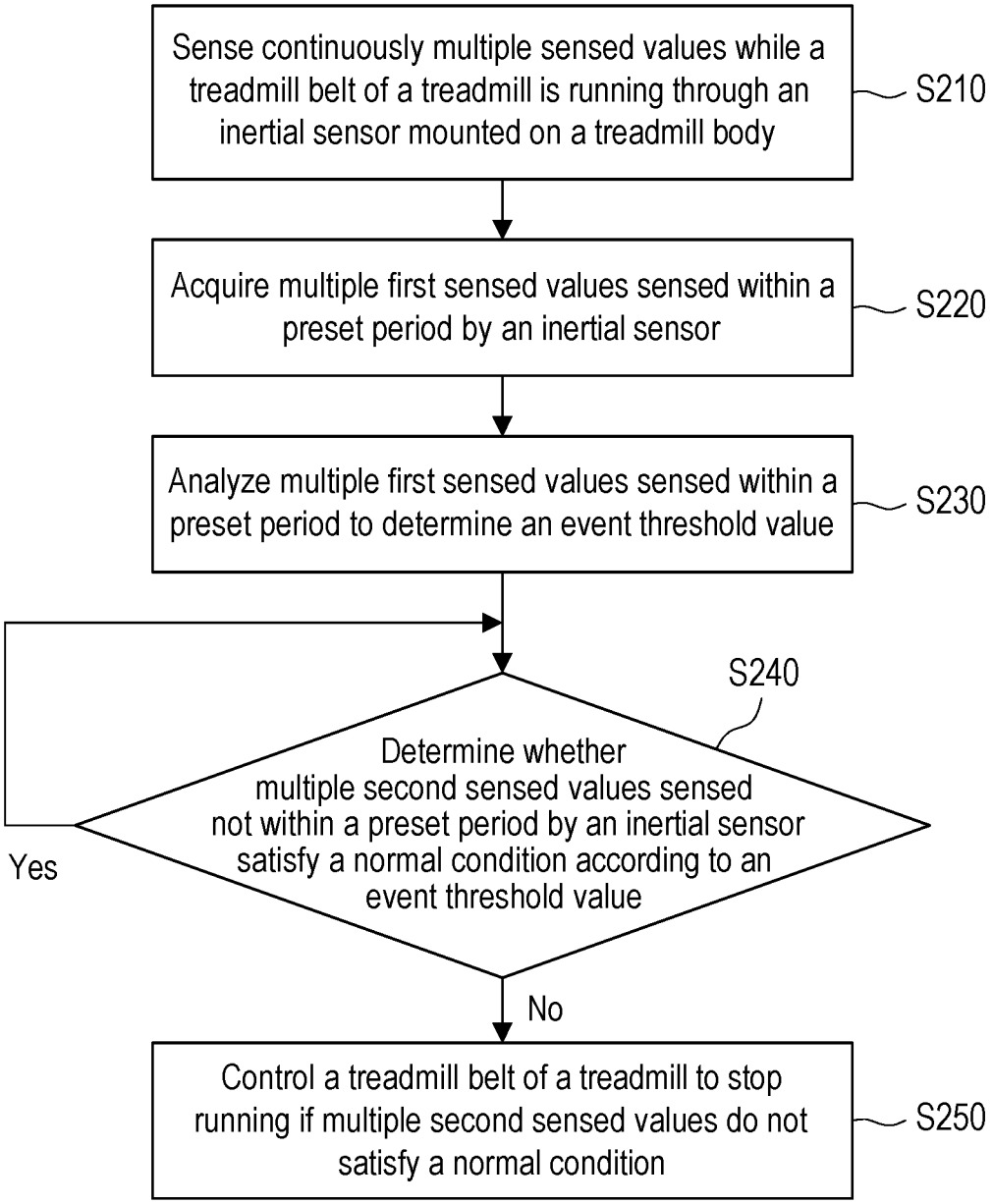
FIG. 2 is a flowchart illustrating an exercise accident detection method according to an embodiment of the disclosure.

In detail, FIG. 2 is a flowchart illustrating an exercise accident detection method according to an embodiment of the disclosure. Please refer to FIG. 1 and FIG. 2 at the same time. The method of this embodiment is suitable for the treadmill 100 mentioned above. The detailed steps of the exercise accident detection method of this embodiment will be described below with various components of the treadmill 100.

In Step S210, multiple sensed values are continuously sensed while the treadmill belt 112 of the treadmill 100 is running by the inertial sensor 120 mounted on the treadmill 100. When the treadmill 100 starts and the user U1 starts to run on the treadmill belt 112, the inertial sensor 120 continuously performs sensing and outputs the multiple sensed values. It should be noted that the treadmill 100 vibrates in response to repeated stepping by the user U1, and the multiple sensed values output by the inertial sensor 120 also change in response to the vibration of the treadmill 100. It may be known that, based on the regularity of a force exerted by the strides of the user U1 on the treadmill 100, the multiple sensed values output by the inertial sensor 120 also regularly change within a normal range.

In Step S220, multiple first sensed values sensed within a preset period by the inertial sensor 120 are acquired by the processor 130. Specifically, under a condition that the user U1 runs normally within the preset period, the processor 130 collects the multiple first sensed values within the preset period output by the inertial sensor 120. A length of the preset period is, for example, 8 seconds or 10 seconds, which can be set according to actual applications, and the disclosure does not limit the length of the preset period.

Next, in Step S230, the multiple first sensed values sensed within the preset period are analyzed by the processor 130 to determine an event threshold value. In other words, the processor 130 determines the event threshold value according to the multiple first sensed values sensed during the user running normally. In some embodiments, a statistical calculation may be directly performed on the multiple first sensed values within the preset period by the processor 130 to determine the event threshold value. For example, the event threshold value may be generated by adding a preset value to a maximum value of the multiple first sensed values within the preset period by the processor 130. In some embodiments, a waveform may be formed by the multiple sensed values with respect to multiple sensed time points output by the inertial sensor 120, and the statistical calculation may be performed according to multiple peaks or multiple valleys formed by the multiple first sensed values within the preset period to determine the event threshold value by the processor 130.

Figure 3:
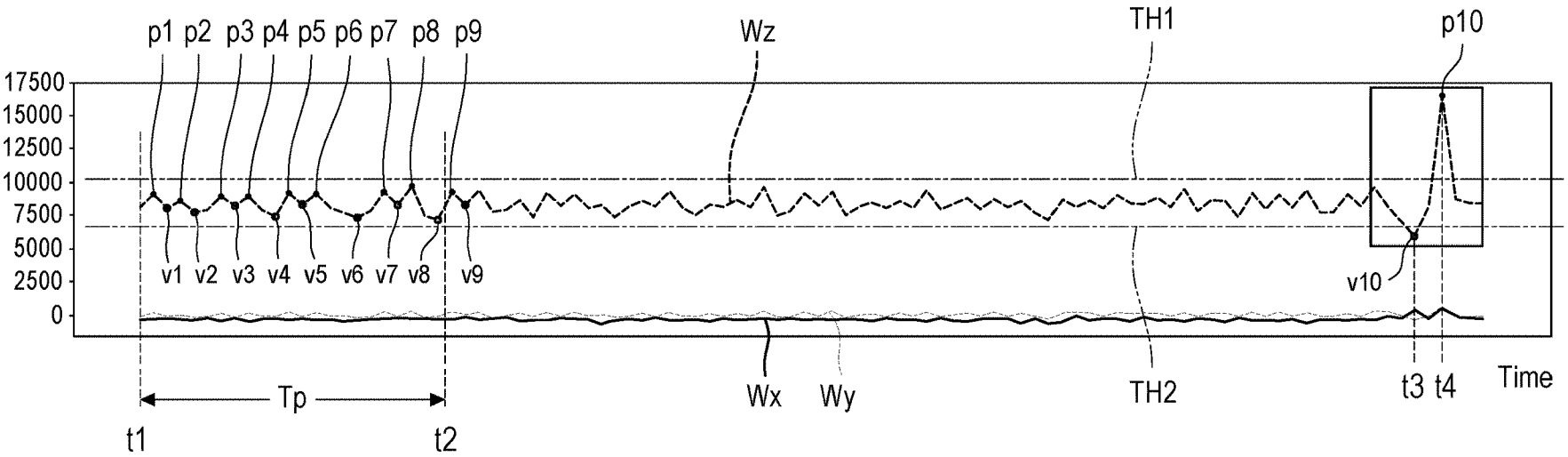
FIG. 3 is a waveform diagram illustrating a waveform formed by sensed values according to an embodiment of the disclosure.

For example, FIG. 3 is a waveform diagram illustrating a waveform formed by sensed values according to an embodiment of the disclosure. Referring to FIG. 3, assuming that the inertial sensor 120 is a three-axis acceleration sensor, and the inertial sensor 120 may sense an X-axis acceleration sensed value, a Y-axis acceleration sensed value, and a Z-axis acceleration sensed value. The X-axis acceleration sensed value may constitute a waveform Wx with respect to multiple sensed time points. The Y-axis acceleration sensed value may constitute a waveform Wy with respect to the multiple sensed time points. The Z-axis acceleration sensed value may constitute a waveform Wz with respect to the multiple sensed time points. Taking the waveform Wz as an example for illustration, the event threshold value is determined according to the first sensed values collected during a preset period Tp between a time point t1 and a time point t2 by the processor 130. In this example, the statistical calculation may be performed according to eight peaks p1~p8 or eight valleys v1~v8 formed within the preset period Tp by the first sensed values to determine an event threshold value TH1 or an event threshold value TH2 correspondingly by the processor 130. In an embodiment, a peak average value of the eight peaks p1~p8 may be calculated by the processor 130, and the event threshold value TH1 is equal to the peak average value plus a preset value. In addition, a valley average value of the eight valleys v1~v8 may also be calculated by the processor 130, and the event threshold value TH2 is equal to the valley average value minus a preset value.

In Step S240, whether multiple second sensed values sensed not within the preset period by the inertial sensor satisfy a normal condition is determined by the processor 130 according to the event threshold value. In some embodiments, after the event threshold value is determined according to the first sensed values, whether the multiple second sensed values sensed not within the preset period by the inertial sensor fall within a normal range defined by the event threshold value may be determined by the processor 130. In other words, through determining whether the multiple second sensed values sensed by the inertial sensor 120 are greater than or smaller than the event threshold value, whether the second sensed values satisfy the normal condition may be determined by the processor 130. If a second sensed value sensed by the inertial sensor 120 does not fall within the normal range defined by the event threshold value, the second sensed value may be determined to be not satisfying the normal condition by the processor 130. In some embodiments, a waveform may be formed by the sensed values output with respect to multiple sensed time points by the inertial sensor 120, and whether the second sensed values satisfy the normal condition may be determined by comparing the event threshold value with the multiple peaks or the multiple valleys formed by the multiple second sensed values.

For example, referring to FIG. 3, after the event threshold value TH1 is determined by the processor 130 according to the multiple peaks p1~p8 within the preset period Tp, whether each peak (such as peak p9, p10) sensed not within the preset period after the time point t2 is greater than the event threshold value TH1 may be determined by the processor 130. As shown in FIG. 3, the peak p9 is not greater than the event threshold value TH1, and some second sensed values associated with the peak p9 are determined to be satisfying the normal condition by the processor 130. However, regarding the peak p10 corresponding to the time point t4 being greater than the event threshold value TH1, some second sensed values associated with the peak p10 may be determined to be not satisfying the normal condition by the processor 130. Alternatively, after the event threshold value TH2 is determined by the processor 130 according to the multiple valleys v1~v8 in the preset period Tp, whether each valley (such as valleys v9, v10) not within the preset period after the time point t2 is smaller than the event threshold value TH2 may be determined by the processor 130. As shown in FIG. 3, the valley v9 is not smaller than the event threshold value TH2, and some second sensed values associated with the valley v9 may be determined to be satisfying the normal condition by the processor 130. However, regarding the valley v10 corresponding to the time point t3 being smaller than the event threshold value TH2, some second sensed values associated with the valley v10 may be determined to be not satisfying the normal condition by the processor 130.

It should be noted that the embodiment of FIG. 3 is described by taking the Z-axis acceleration sensed value as an example, but the disclosure is not limited thereto. According to a setting method of the three-axis acceleration sensor, the processor 130 may also take the X-axis acceleration sensed value or the Y-axis acceleration sensed value to determine the event threshold value and detect whether an exercise accident during the use of the treadmill 100 occurs according to the X-axis acceleration sensed value or the Y-axis acceleration sensed value.

Afterward, if the second sensed values sensed by the inertial sensor 120 do not satisfy the normal condition (Step S240 determines NO), in Step S250, the processor 130 controls the treadmill belt 112 of the treadmill 100 to stop running. For example, in response to the valley v10 corresponding to the time point t3 being smaller than the event threshold value TH2, the processor 130 may control the motor for driving the treadmill belt 112 to stop running. Alternatively, in response to the peak p10 corresponding to the time point t4 being greater than the event threshold value TH1, the processor 130 may control the motor for driving the treadmill belt 112 to stop running. In an embodiment, the processor 130 may control the motor for driving the treadmill belt 112 to stop running, so that the treadmill belt 112 of the treadmill 100 stops running. In an embodiment, the power management device 140 receives a power-off signal from the processor 130 and stops supplying power to the treadmill 100, so that the treadmill belt 112 of the treadmill 100 stops running.

Specifically, if the second sensed values sensed by the inertial sensor 120 do not satisfy the normal condition, the processor 130 may determine that an exercise accident during the use of the treadmill 100 occurs and control the treadmill belt 112 to stop running. In detail, if the user U1 falls down or a foreign object hits the treadmill 100, the body of the user U1 or the foreign object hits the treadmill 100, and the second sensed value sensed by the inertial sensor 120 changes drastically. Based on this, since an object threshold value is determined according to the first sensed value sensed while the user U1 running normally, when the body of the user U1 hits the treadmill 100 or the foreign object hits the treadmill 100 vigorously, the sensed value output by the inertial sensor 120 exceeds a normal range defined by the object threshold value. Therefore, whether an exercise accident during the use of the treadmill 100 occurs may be detected by the processor 130 according to the sensed values output by the inertial sensor 120, so as to determine whether to control the treadmill belt 112 to stop running, thereby improving the safety of using the treadmill 100.

It is worth mentioning that, as the running speed of the user U1 changes, the force exerted by the strides of the user U1 on the treadmill 100 also changes. Therefore, in some embodiments, during a process of the user U1 using the treadmill 100, the object threshold value may be updated by the processor 130.

In some embodiments, after determining the object threshold value according to the first sensed values within a preset period, multiple first sensed values sensed within another preset period by the inertial sensor 120 may be acquired by the processor 130, and the event threshold value is updated by analyzing the multiple first sensed values sensed within the other preset period. That is to say, in some embodiments, the processor 130 may periodically calculate and update the event threshold value. For example, the processor 130 may calculate a new event threshold value every 3 minutes according to the first sensed values within the preset period and use the new event threshold value to update an old event threshold value. In this way, the event threshold value may be adaptively adjusted in response to the force exerted by the strides of the user U1.

In some embodiments, the event threshold value is updated by the processor 130 according to a set speed in response to a change of the set speed of the treadmill 100. In some embodiments, the event threshold value may be updated correspondingly in response to a certain increase in the set speed. In detail, the object threshold value may first be determined by the processor 130 according to the first sensed values within a preset period, and the first sensed values are sensed during the set speed being a first speed.

Afterward, when the set speed of the treadmill 100 is adjusted from the first speed to a second speed by the user U1, a threshold adjustment value may be acquired by the processor 130 by looking up a table according to a difference between the first speed and the second speed, and then the object threshold value is updated by adding or subtracting the threshold adjustment value to the object threshold value.

On the other hand, in addition to using the sensed values of the inertial sensor 120 to detect whether the user U1 has fallen or a foreign object has hit the treadmill 100, in the embodiment of the disclosure, included angles between the pedestal 111 and the ground may also be calculated by the processor 130 according to the sensed values of the inertial sensor 120, so as to detect whether a foreign object is drawn under the pedestal 111 by the treadmill belt 112 in motion.

Figure 4:
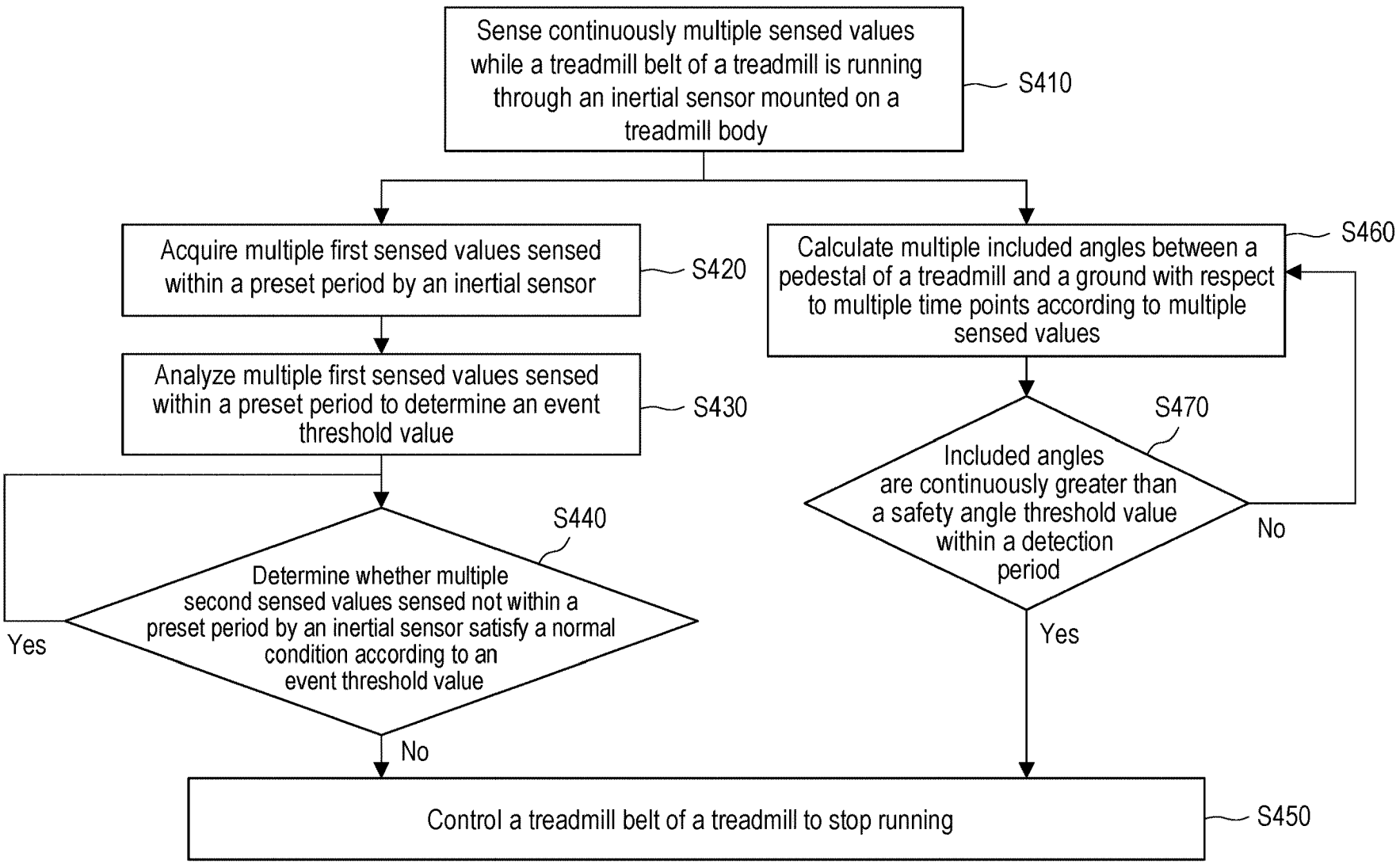
FIG. 4 is a flowchart illustrating an exercise accident detection method according to an embodiment of the disclosure.

In detail, FIG. 4 is a flowchart illustrating an exercise accident detection method according to an embodiment of the disclosure. Please refer to FIG. 1 and FIG. 4 at the same time. The method of this embodiment is suitable for the above-mentioned treadmill 100. The detailed steps of the exercise accident detection method of this embodiment will be described below with various components of the treadmill 100.

In Step S410, multiple sensed values are continuously sensed while the treadmill belt 112 of the treadmill 100 is running by the inertial sensor 120 mounted on the treadmill 100. In Step S420, multiple first sensed values sensed within a preset period by the inertial sensor 120 are acquired by the processor 130. In Step S430, the multiple first sensed values sensed within the preset period are analyzed by the processor 130 to determine an event threshold value. In Step S440, whether multiple second sensed values sensed not within the preset period by the inertial sensor 120 satisfy a normal condition is determined by the processor 130 according to the event threshold value. If the multiple second sensed values sensed by the inertial sensor 120 do not satisfy the normal condition (Step S440 determines NO), in Step S450, the processor 130 controls the treadmill belt 112 of the treadmill 100 to stop running. The detailed implementations of the above Step S410~Step S450 have been clearly explained in Step S210~Step S250 in the embodiment of FIG. 2 and will not be repeated here.

Figure 5:
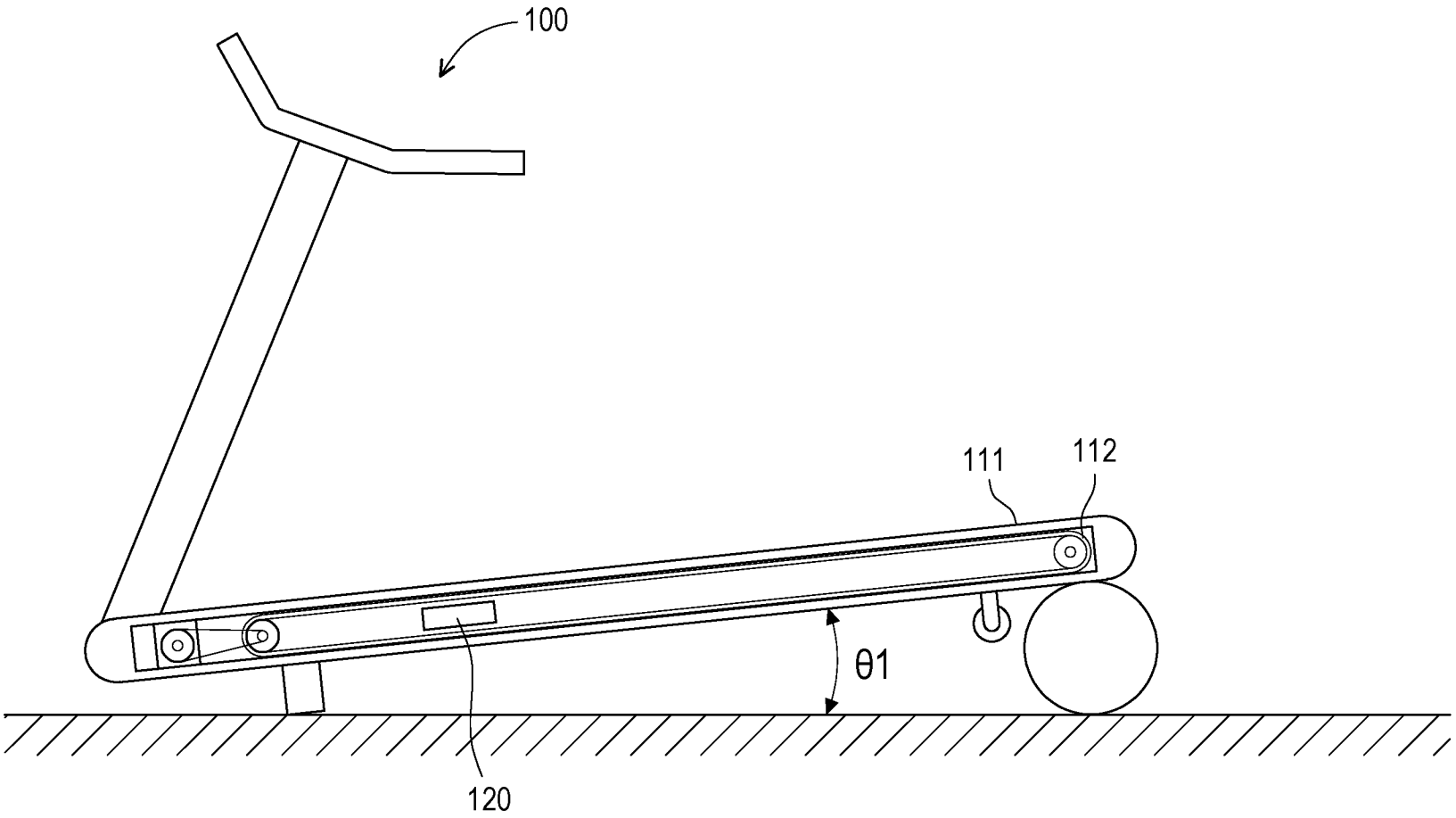
FIG. 5 is a schematic diagram illustrating an angle between a pedestal and a ground of a treadmill according to an embodiment of the disclosure.

It should be noted that, in Step S460, the multiple included angles between the pedestal 111 of the treadmill 100 and the ground with respect to multiple time points are calculated according to the sensed values by the processor 130. In some embodiments, the included angles between the pedestal 111 and the ground may be calculated by the processor 130 according to three-axis acceleration sensed values output by the three-axis acceleration sensor. Alternatively, the included angles between the pedestal 111 and the ground may be calculated by the processor 130 according to three-axis angular velocity sensed values output by the gyroscope. For example, FIG. 5 is a schematic diagram illustrating an angle between a pedestal and a ground of a treadmill according to an embodiment of the disclosure. Please refer to FIG. 5. The inertial sensor 120 is mounted on the pedestal 111, and an included angle θ1 between the pedestal 111 and the ground may be calculated by the processor 130 according to the sensed value output by the inertial sensor 120.

In some embodiments, the multiple included angles with respect to the multiple time points may be calculated continuously by the processor 130 according to the sensed values output by the inertial sensor 120. Whether to control the treadmill belt 112 of the treadmill 100 to stop running may be determined by the processor 130 according to the multiple included angles. In this embodiment, in Step S470, whether the multiple included angles are continuously greater than a safety angle threshold value within a detection period is determined by the processor 130. The detection period is, for example, 3 seconds, which is not limited in the disclosure. Specifically, whether the multiple angles corresponding to different time points are continuously greater than the safety angle threshold value may be determined by the processor 130. Assuming that the detection period is 3 seconds, if the multiple angles calculated by the processor 130 within the 3 seconds are all greater than the safety angle threshold value, the processor 130 may determine that the multiple included angles are continuously greater than the safety angle threshold value within the detection period.

If the multiple included angles are continuously greater than the safety angle threshold value within the detection period (Step S470 determines YES), in Step S450, the processor 130 controls the treadmill belt 112 of the treadmill 100 to stop running. Therefore, as shown in FIG. 5, if the foreign subject is drawn under the bottom of the pedestal 111 and leads to the pedestal 111 lifting up, the multiple included angles (for example, the included angles θ1) corresponding to the multiple time points between the pedestal 111 of the treadmill 100 and the ground are continuously greater than the safety angle threshold value within the detection period. Therefore, the processor 130 may control the treadmill belt 112 of the treadmill 100 to stop running in response to the multiple included angles being continuously greater than the safety angle threshold within the detection period. In this way, it is possible to prevent the foreign subject from being further drawn under the bottom of the pedestal 111 by the treadmill belt 112 and causing expansion of injuries.

In summary, in the embodiment of the disclosure, the inertial sensor is mounted on the treadmill body to perform sensing. When the user is exercising on the treadmill, some sensed values may be collected first to determine the event threshold value. Whether other subsequent sensed values satisfy the normal condition is determined by using the event threshold value, thereby detecting whether the user has fallen or the foreign object has fallen onto the treadmill. When a sensed value not satisfying the normal condition is detected, the treadmill belt of the treadmill stops, so as to avoid causing expansion of injuries to the user of the treadmill. In addition, the included angle between the pedestal of the treadmill and the ground may be calculated according to the sensed value output by the inertial sensor. Therefore, whether the foreign subject is drawn under the bottom of the treadmill may be detected according to the included angle between the pedestal of the treadmill and the ground, and consequently whether to control the treadmill belt to stop running is determined. In this way, the safety of using the treadmill can be significantly improved.

Although the disclosure has been disclosed above with the embodiments, it is not intended to limit the disclosure. Persons with ordinary knowledge in the technical field may make some changes and modifications without departing from the spirit and scope of the disclosure. The scope of protection of the disclosure should be defined by the appended claims.

What is claimed is:

1. A treadmill, comprising:

a treadmill body;

an inertial sensor, mounted on the treadmill body, continuously sensing a plurality of sensed values while a treadmill belt of the treadmill is running;

a processor, coupled to the inertial sensor, acquiring a plurality of first sensed values sensed within a preset period by the inertial sensor, analyzing the plurality of first sensed values sensed within the preset period to determine an event threshold value, and determining whether a plurality of second sensed values sensed not within the preset period by the inertial sensor satisfy a normal condition according to the event threshold value, wherein, in response to the plurality of second sensed values not satisfying the normal condition, the processor controls the treadmill belt of the treadmill to stop running, wherein the treadmill body comprises a pedestal disposed with the treadmill belt, the processor calculates a plurality of included angles between the pedestal of the treadmill and a ground with respect to a plurality of time points according to the plurality of sensed values, and the processor determines whether to control the treadmill belt of the treadmill to stop running according to the plurality of included angles.

2. The treadmill as claimed in claim 1, wherein the plurality of sensed values form a waveform with respect to a plurality of sensed time points, wherein the processor performs a statistical calculation according to a plurality of peaks or a plurality of valleys formed by the plurality of first sensed values within the preset period to determine the event threshold value.

3. The treadmill as claimed in claim 2, wherein the processor determines whether the plurality of second sensed values satisfy the normal condition by comparing the event threshold value with a plurality of peaks or a plurality of valleys formed by the plurality of second sensed values.

4. The treadmill as claimed in claim 1, wherein the processor acquires a plurality of first sensed values sensed within another preset period by the inertial sensor, and analyzes the plurality of first sensed values sensed within the other preset period to update the event threshold value.

5. The treadmill as claimed in claim 1, wherein the processor updates the event threshold value according to a set speed in response to a change of the set speed of the treadmill.

6. The treadmill as claimed in claim 1, wherein the inertial sensor comprises an acceleration sensor, a gyroscope or a combination thereof, and the plurality of sensed values comprise acceleration sensed values, angular velocity sensed values or a combination thereof.

7. The treadmill as claimed in claim 1, further comprising a power management device coupled to the processor, wherein the power management device receives a power-off signal from the processor and stops supplying power, so that the treadmill belt of the treadmill stops running.

8. The treadmill as claimed in claim 1, wherein in response to the plurality of included angles being continuously greater than a safety angle threshold value within a detection period, the processor controls the treadmill belt of the treadmill to stop running.

9. An exercise accident detection method, suitable for a treadmill, comprising:

sensing, by an inertial sensor mounted on the treadmill, a plurality of sensed values continuously while a treadmill belt of the treadmill is running;

acquiring, by the inertial sensor, a plurality of first sensed values sensed within a preset period;

analyzing the plurality of first sensed values sensed within the preset period to determine an event threshold value;

determining whether a plurality of second sensed values sensed not within the preset period by the inertial sensor satisfy a normal condition according to the event threshold value; and controlling the treadmill belt of the treadmill to stop running in response to the plurality of second sensed values not satisfying the normal condition, wherein the treadmill body comprises a pedestal disposed with the treadmill belt, wherein the method further comprises:

calculating a plurality of included angles between the pedestal of the treadmill and a ground with respect to a plurality of time points according to the plurality of sensed values; and determining whether to control the treadmill belt of the treadmill to stop running according to the plurality of included angles.

* * * * *